US009752434B2

(12) United States Patent
Hall et al.

(10) Patent No.: US 9,752,434 B2
(45) Date of Patent: Sep. 5, 2017

(54) BLOCK CAPABLE OF SUPPORTING MULTIPLE PICKS

(71) Applicant: Novatek IP, LLC, Provo, UT (US)

(72) Inventors: David R. Hall, Provo, UT (US); Ronald B. Crockett, Spring City, UT (US); Dwain Norris, Spanish Fork, UT (US)

(73) Assignee: NOVATEK IP, LLC, Provo, UT (US)

( * ) Notice: Subject to any disclaimer, the term of this patent is extended or adjusted under 35 U.S.C. 154(b) by 0 days.

(21) Appl. No.: 14/809,071

(22) Filed: Jul. 24, 2015

(65) Prior Publication Data

US 2016/0024920 A1 Jan. 28, 2016

Related U.S. Application Data

(60) Provisional application No. 62/029,249, filed on Jul. 25, 2014.

(51) Int. Cl.
*E21C 35/18* (2006.01)
*E21C 35/19* (2006.01)
*E21C 25/10* (2006.01)

(52) U.S. Cl.
CPC ..... *E21C 35/19* (2013.01); *E21C 25/10* (2013.01); *E21C 35/18* (2013.01); *E21C 2035/191* (2013.01)

(58) Field of Classification Search
CPC ..... E21C 35/18
See application file for complete search history.

(56) References Cited

U.S. PATENT DOCUMENTS 3,101,934 A * 8/1963 Poundstone ..... E21C 35/18 279/16
3,325,219 A * 6/1967 Valantin ..... E21C 25/10 299/101
3,847,439 A * 11/1974 Allen ..... E21C 35/23 299/81.1

(Continued)

FOREIGN PATENT DOCUMENTS

EP 0758711 A2 2/1997
WO 2013126944 A1 9/2013

OTHER PUBLICATIONS

International Preliminary Report on Patentability issued in corresponding International Application PCT/US2015/042125 dated Feb. 9, 2017, 10 pages.

*Primary Examiner* — John Kreck

(57) ABSTRACT

In such fields as road milling, mining and trenching it is often desirable to engage and degrade tough materials such as asphalt, concrete and rock. To do so, degradation picks comprising hardened distal tips may be secured to an exterior of a movable support such as a rotatable drum or continuous chain so as to be repeatedly brought into contact with a material to be degraded. To secure such degradation picks to the movable support, a block comprising a body with a base surface rigidly attachable to a movable support is disclosed. A first receptacle with a first central axis may be disposed on an external surface of the body and formed to receive a first removable degradation pick. A second receptacle with a second central axis may also be disposed on the external surface and formed to receive a second removable degradation pick where the first and second central axes are nonparallel.

16 Claims, 8 Drawing Sheets

(56) References Cited

U.S. PATENT DOCUMENTS

| | | | | |
|---|---|---|---|---|
| 4,225,190 | A | 9/1980 | Hoffmann | |
| 4,325,580 | A | 4/1982 | Swisher, Jr. et al. | |
| 4,342,486 | A | 8/1982 | O'Neill | |
| 4,411,475 | A | 10/1983 | Best et al. | |
| 5,092,658 | A | 3/1992 | Smith | |
| 5,536,073 | A * | 7/1996 | Sulosky | B28D 1/186 299/106 |
| 5,639,180 | A | 6/1997 | Sulosky et al. | |
| 5,647,641 | A | 7/1997 | Sulosky et al. | |
| 5,842,747 | A | 12/1998 | Winchester | |
| 6,832,818 | B2 | 12/2004 | Luciano | |
| 7,475,949 | B2 | 1/2009 | Helsel et al. | |
| 8,950,821 | B2 | 2/2015 | Fundakowski et al. | |
| 2006/0255649 | A1 * | 11/2006 | Dawood | E21C 35/18 299/87.1 |

* cited by examiner

PRIOR ART

PRIOR ART

BLOCK CAPABLE OF SUPPORTING MULTIPLE PICKS

CROSS REFERENCE TO RELATED APPLICATIONS

This patent application claims priority to U.S. Provisional Pat. App. No. 62/029,249 entitled "Block Capable of Supporting Multiple Attack Tools" and filed Jul. 25, 2014, which is incorporated herein by reference for all that it contains.

BACKGROUND OF THE INVENTION

Degradation picks are known to be used in such fields as road milling, mining and trenching to engage and degrade tough materials such as asphalt, concrete and rock. Such degradation picks may be secured to an exterior of a movable support such as a rotatable drum or continuous chain so as to be repeatedly brought into contact with a surface of a material to be degraded. Each degradation pick may comprise a hardened tip disposed on a distal end thereof and designed for repeated impact with a tough material. Such repeated impact may break up the tough material into aggregate pieces. To secure such degradation picks to the movable support, a generally cylindrical shank opposite the hardened tip may be disposed within a bore within a block that is rigidly fixed to the movable support.

As this repeated contact may cause significant wear, it may be desirable to increase the number of degradation picks in an operation to reduce the wear on each individual degradation pick and, consequently, extend its functional life. It may be especially desirable to position additional degradation picks in strategic locations around the movable support where wear is likely to occur. For example, the edge of a rotatable drum when viewed along a rotational axis thereof may engage tough materials not only around a perimeter of the drum but also beyond the edge of the drum. In such cases, it may be desirable to position additional degradation picks proximate the edge of the drum to engage this additional material. Traditional blocks, however, comprise a given footprint requiring a certain amount of space on the exterior surface of the movable support thus limiting the tightness of any degradation pick placement.

For example, degradation picks may be disposed proximate an edge of a rotatable drum by attaching a ring to an end of the drum to hold additional degradation pick blocks. For instance, U.S. Pat. No. 4,225,190 to Hoffmann describes a mining auger which is used in the underground mining of coal comprising an end ring along its outer periphery. A plurality of tool holders is provided along a free edge of the end ring. The longitudinal axis of each tool holder coincides with the longitudinal axis of each cutting tool bit arranged in the respective tool holder.

By way of another example, U.S. Pat. No. 4,411,475 to Best et al. describes a cutting drum for an extracting machine assembled of a base body having a frustoconical configuration and an end ring which is detachably mounted to a major end face of the base body. The end ring is provided along its periphery with a plurality of tool holders for accommodating picks.

Despite these advancements in the art, the need for even tighter formations of degradation picks than those possible by arranging tool holders around the periphery of an end ring is still desirable.

BRIEF SUMMARY OF THE INVENTION

In such fields as road milling, mining and trenching it is often desirable to engage and degrade tough materials such as asphalt, concrete and rock. To do so, degradation picks comprising hardened distal tips may be secured to an exterior of a movable support such as a rotatable drum or continuous chain so as to be repeatedly brought into contact with a material to be degraded. To secure such degradation picks to the movable support, a block comprising a body with a base surface rigidly attachable to a movable support is disclosed. A first receptacle with a first central axis may be disposed on an external surface of the body and formed to receive a first removable degradation pick. A second receptacle with a second central axis may also be disposed on the external surface and formed to receive a second removable degradation pick where the first and second central axes are nonparallel.

The block body may comprise a sagittal plane passing from a posterior end to an anterior end thereof such that it separates the body into two sides. The first receptacle may be disposed proximate the posterior end and comprise a central axis falling substantially on the sagittal plane while the second receptacle sits proximate the anterior end with a central axis extending away from the sagittal plane.

When degradation picks are disposed within the first and second receptacles a distal tip of one of the degradation picks may extend beyond a footprint of the body's base surface while a distal tip of the other degradation pick lies within the footprint. Additionally, when the body is rigidly attached to a movable support, one of the distal tips may extend beyond an edge of the movable support while the other distal tip lies within the edge.

The receptacles of the block body may provide access to proximal ends of the degradation picks such that they may be forced from the receptacles from the rear. Furthermore, the base surface of the body may be shaped such that access to the proximal ends is available even when the body is attached to a movable support.

A rotatable drum or continuous chain may form the movable support to which the block body may be attached. In embodiments where a rotatable drum is employed, the block body may be rigidly attached proximate an edge of the rotatable drum when viewed along a rotational axis thereof. An end ring may also be disposed proximate the edge with the block body rigidly attached to the end ring. Such a rotatable drum may have a number of degradation picks arranged thereon in a helical pattern where the receptacles of the block body continue the helical pattern.

In some embodiments, the block body may be formed of a unitary mass. Furthermore, in certain situations, the receptacles may be integrally formed of the unitary mass comprising a bore hole formed in the unitary mass and a supporting structure encompassing each bore hole.

In various embodiments, the block body may further comprise additional receptacles. Such receptacles may all have nonparallel central axes. A central axis of at least one of the receptacles may extend away from a sagittal plane passing through the body on one side while a central axis of another extends away on an opposite side.

DETAILED DESCRIPTION OF THE DRAWINGS

Figure 1:
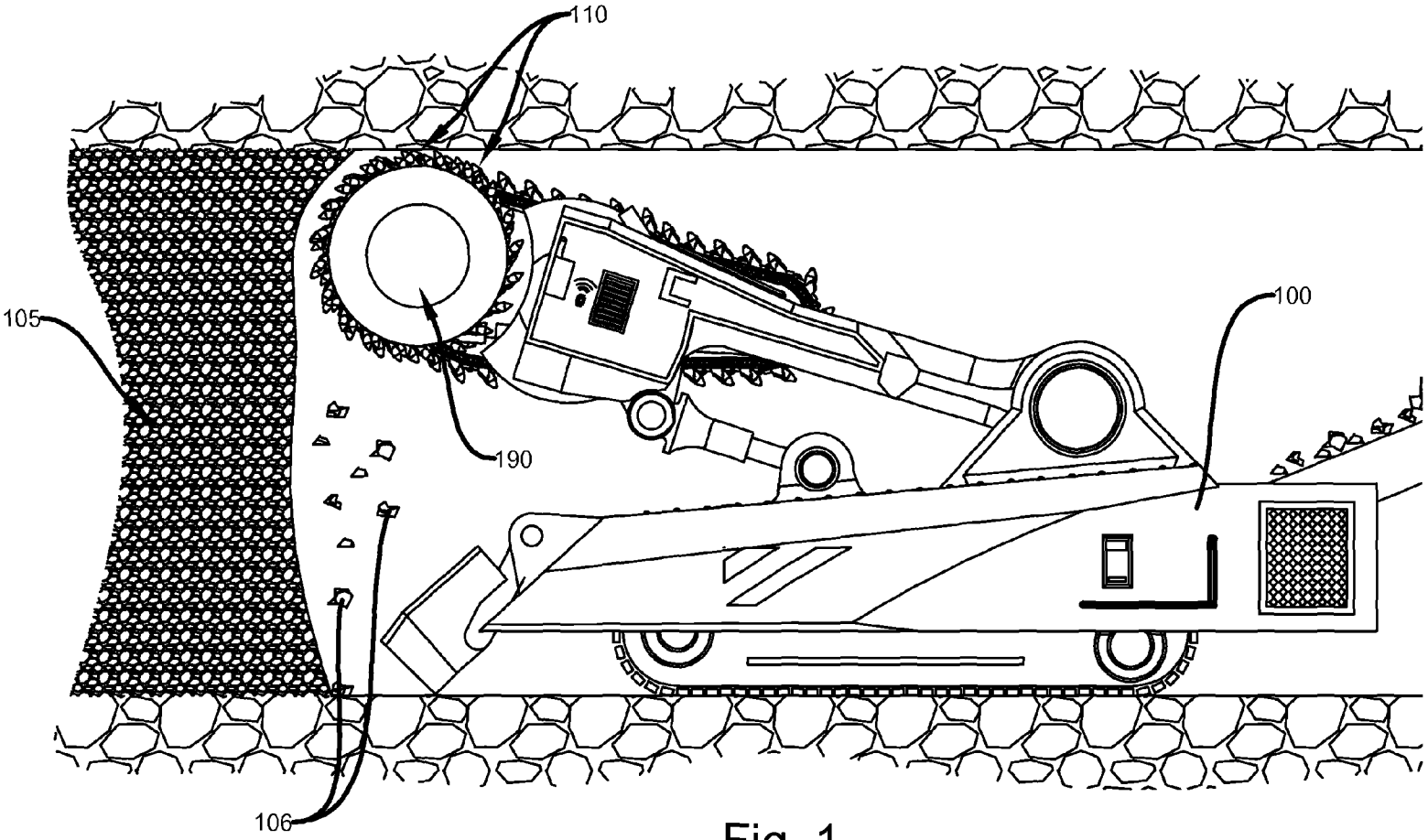
FIG. 1 is an orthogonal side view of an embodiment of a formation degradation machine, one of a variety of styles used in such fields as road milling, mining and trenching to engage and degrade tough materials such as asphalt, concrete and rock.

FIG. 1 shows an embodiment of a formation degradation machine 100, one of a variety of styles used in such fields as road milling, mining and trenching to engage and degrade tough materials such as asphalt, concrete and rock. In the embodiment shown, the degradation machine 100 is located in a subsurface mine and engaging a wall of coal. The formation degradation machine 100 may comprise a rotatable drum 190 that may be rotated about a central axis by the formation degradation machine 100.

A plurality of degradation picks 110 may be secured to an exterior of the rotatable drum 190. As the rotatable drum 190 is rotated the degradation picks 110 may be repeatedly brought into contact with a surface of a material 105 to be degraded. Such repeated impact may break up the material 105 into aggregate pieces 106 that may be removed. While the embodiment shown depicts a rotatable drum 190 as part of a mining operation it should be understood that the present invention may also comprise degradation picks secured to a continuous chain to engage various materials as the chain is set in motion.

Figure 2:
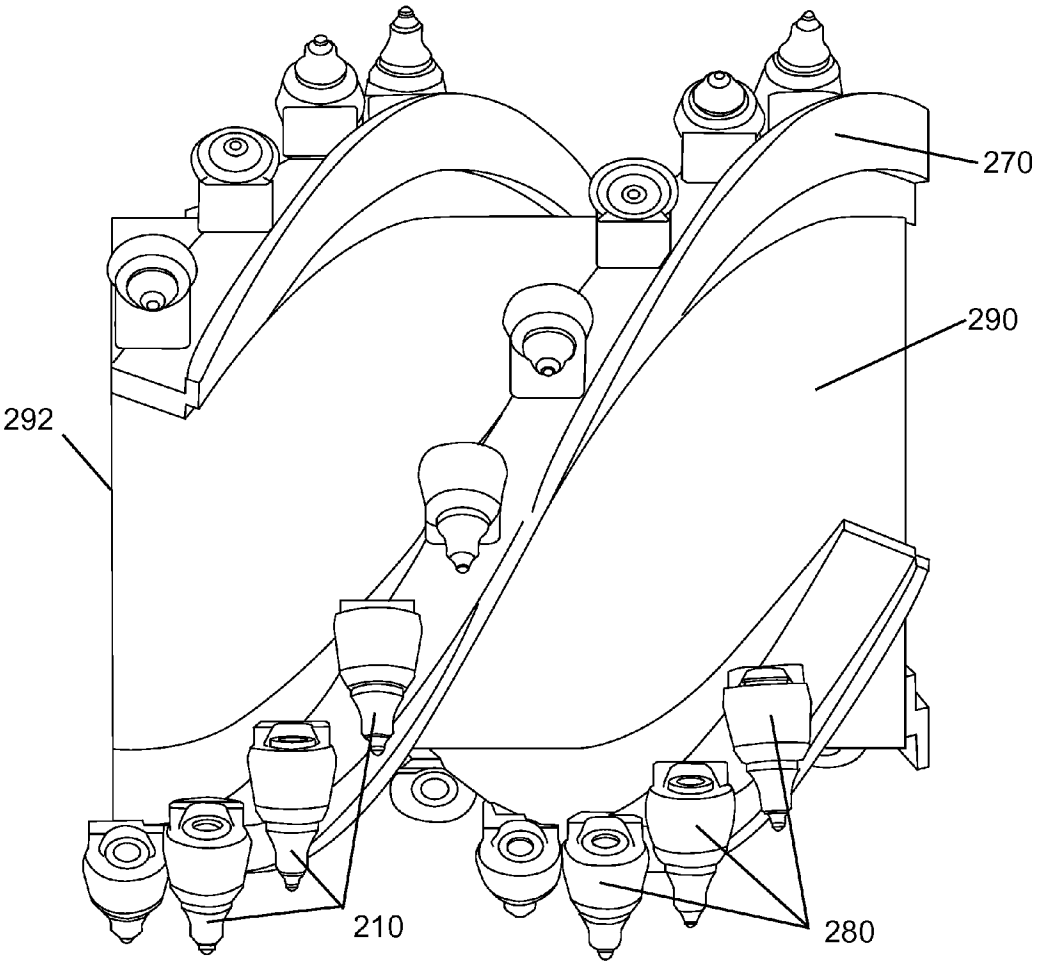
FIGS. 2 and 3 are orthogonal front views of embodiments of rotatable drums known in the art, each with a plurality of degradation picks secured thereto that may be repeatedly brought into contact with a material to be degraded as the drum is rotated.

FIG. 2 shows an embodiment of a rotatable drum 290 of a type known in the art. A plurality of blocks 280 may be disposed on helical flanges 270 wrapping around an exterior of the rotatable drum 290. A plurality of degradation picks 210, each comprising a hardened distal tip opposite a proximate shank, may be inserted within a bore hole disposed in each of the plurality of blocks 280 by their respective shanks Rotation of the rotatable drum 290 may bring the hardened tips of the degradation picks 210 into repeated contact with a material (not shown) to be degraded. As the material is degraded, aggregate pieces of material may be channeled away from the points of impact by the helical flanges 270.

Adjacent an edge 292 of the rotatable drum 290 the degradation picks 210 may experience wear from both material normal to the rotatable drum 290 as well as beyond the edge 292 of the drum when viewed from along a rotational axis thereof. For this reason, or for a variety of others, it may be desirable to increase the number of degradation picks 210 adjacent this edge 292 or in other parts of the rotatable drum 290. This may reduce the wear experienced by each individual degradation pick and, consequently, extend its functional life.

Figure 3:
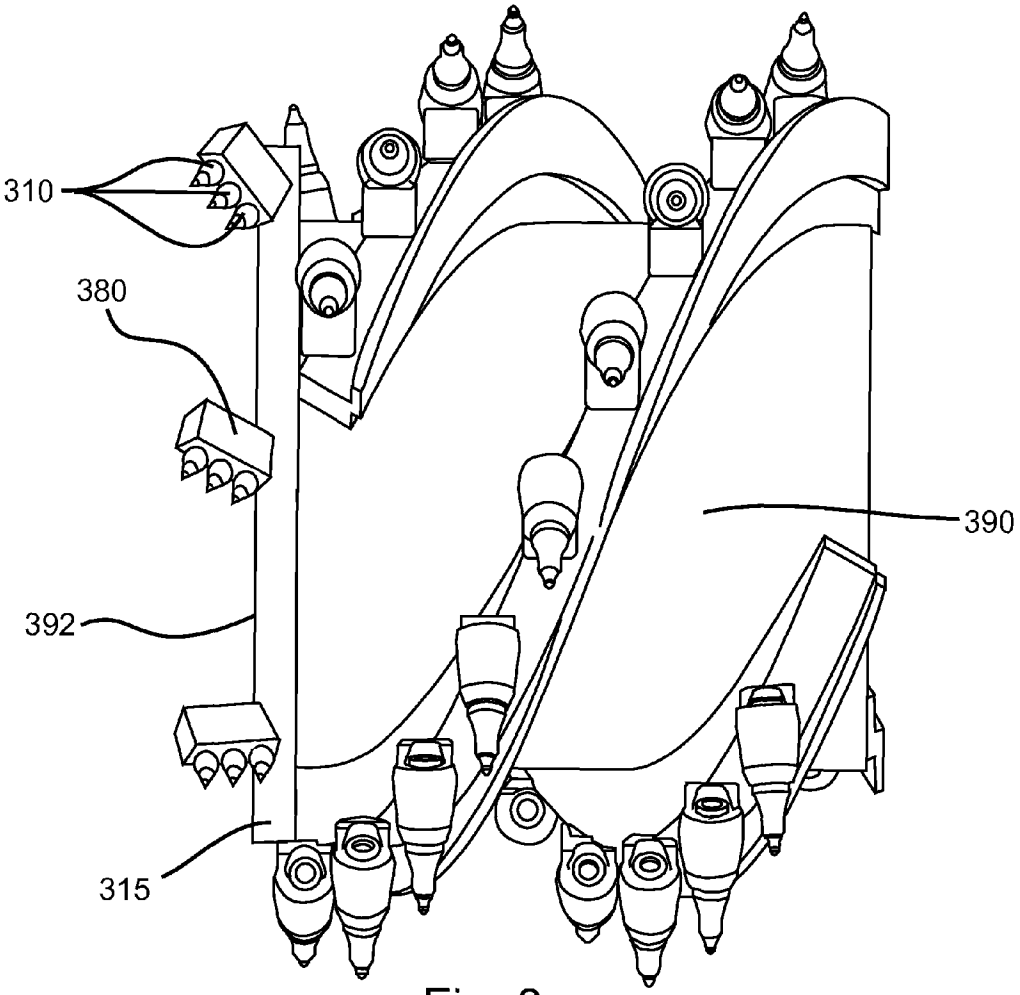

FIG. 3 shows another embodiment of a rotatable drum 390 of a type known in the art. In an attempt to increase the number of degradation picks disposed adjacent an edge 392 of the rotatable drum 390, a plurality of support structures 380 may be disposed on an end ring 315 secured adjacent the edge 392. A plurality of degradation picks 310 are inserted into bore holes within each of the support structures 380. As can be seen, such degradation picks 310 are aligned in a single plane with each subsequent pick at a greater radial distance from a rotational axis of the rotatable drum 390. While these support structures 380 increase the number of degradation picks disposed adjacent the edge 392, the increased moment arm caused by the increased radial distance may cause the support structures 380 to fail at their respective bases. Furthermore, degradation picks aligned in a single plane may not effectively disperse the impact forces experienced among the degradation picks.

Figure 4:
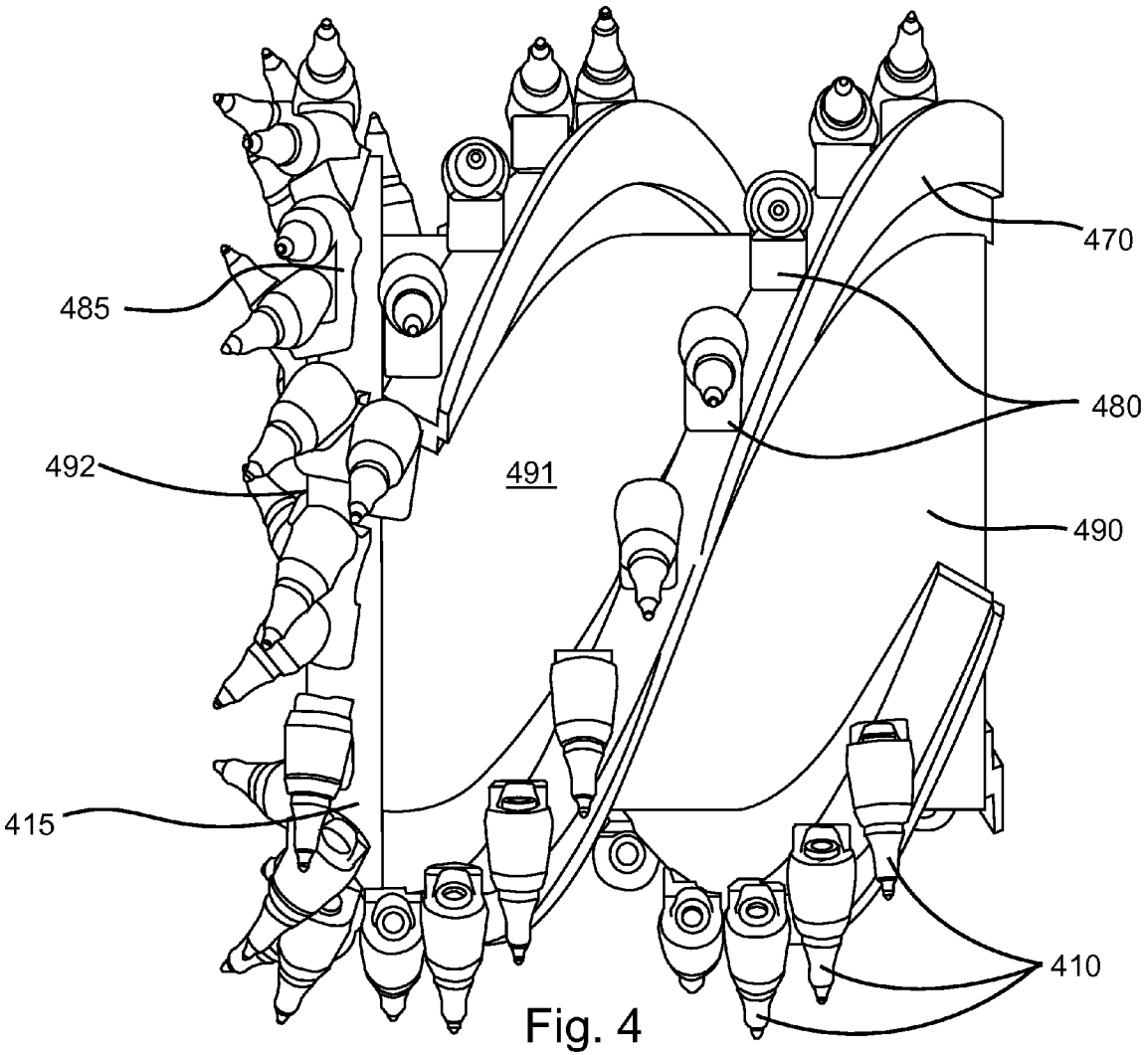
FIG. 4 is an orthogonal front view of an embodiment of rotatable drum of the present invention with an end ring disposed proximate an edge thereof and a plurality of block bodies attached to the end ring.

FIG. 4 shows an embodiment of a rotatable drum 490 of the present invention comprising a substantially cylindrical body 491. In other embodiments, such a body may be generally cylindrical, conical or frustoconical in shape. A plurality of blocks 480 may be disposed on helical flanges 470 wrapping around an exterior of the body 491, each receiving one of a plurality of degradation picks 410. The helical flanges 470 may channel aggregate pieces of material away from points of impact by the plurality of degradation picks 410 but may not be necessary in certain applications.

An end ring 415 may be secured adjacent an edge 492 of the body 491. At least one high capacity block 485 may be attached to the end ring 415. The high capacity block 485 may comprise at least two receptacles capable of receiving degradation picks 410. This may allow for additional degradation picks 410 to be placed in a strategic location on the rotatable drum 490 while occupying a reduced footprint. Furthermore, the degradation picks 410 disposed in the high capacity block 485 may continue the helical pattern set by the helical flanges 470 thus aiding the channeling away of aggregate pieces of material. While the present embodiment depicts high capacity blocks on an end ring 415, other embodiments may comprise high capacity blocks disposed in a variety of locations or patterns.

Figure 5:
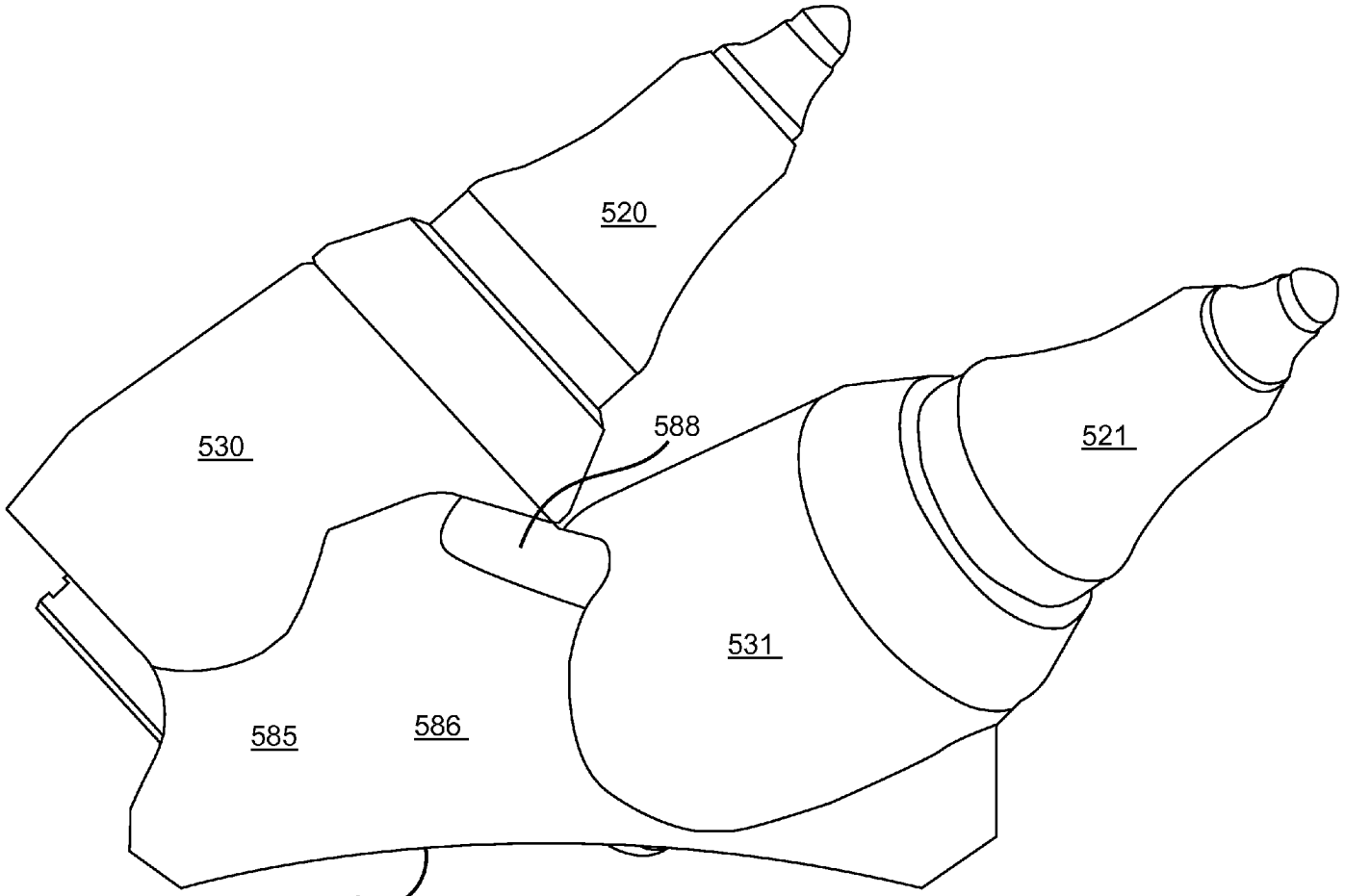
FIGS. 5 and 6 are orthogonal side and front views respectively of an embodiment of a block comprising two receptacles each retaining a degradation pick.
Figure 6:
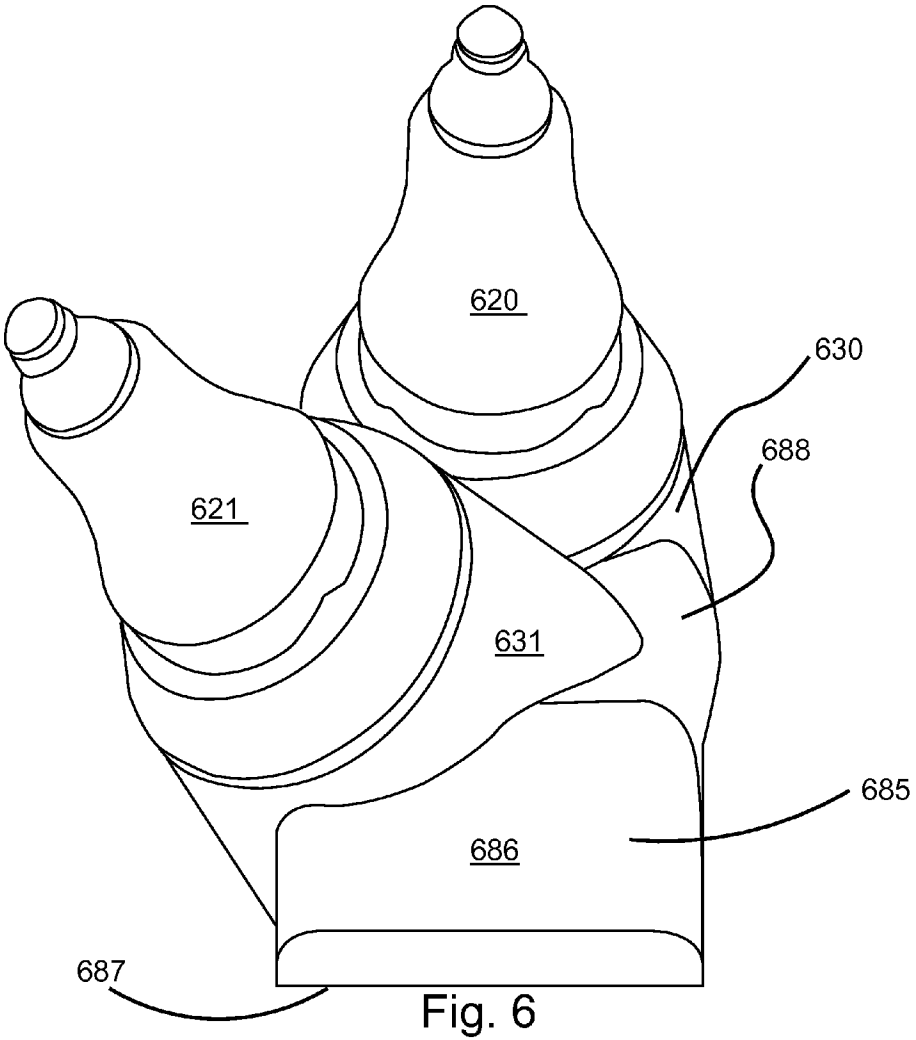

FIGS. 5 and 6 show an embodiment of a high capacity block 585, 685. The high capacity block 585, 685 may be formed from a body 586, 686 comprising a base surface 587, 687 rigidly attachable to a movable support (not shown) and an external surface 588, 688 opposite the base surface 587, 687. A first receptacle 530, 630 and a second receptacle 531, 631 may be disposed upon the external surface 588, 688.

A first degradation pick 520, 620 and a second degradation pick 521, 621 may be removably secured to the first receptacle 530, 630 and second receptacle 531, 631, respectively. As can be seen in the embodiments shown in FIGS. 5 and 6, a distal tip of the second degradation pick 521, 621 may extend beyond a footprint of the base surface 587, 687 while a distal tip of the first degradation pick 520, 620 lies within the footprint. Also, as can be seen in the embodiment shown in FIG. 4, when such a high capacity block is rigidly attached to a rotatable drum, a distal tip of the second degradation pick may extend beyond an edge of the rotatable drum while a distal tip of the first degradation pick lies within the edge.

As seen in FIG. 5, the first receptacle 530 and second receptacle 531 may provide access to proximal ends of the first degradation pick 520 and second degradation pick 521, such that they may be forced from their respective receptacles. In various embodiments, the base surface 587 may be shaped such that the proximal ends of the first and second degradation picks 520, 521, respectively, are accessible even when attached to a movable support.

As seen in FIG. 6, if a sagittal plane were to pass through the body 686 from a posterior end to an anterior end thereof and separate the body into two sides, a central axis of the first receptacle 630, disposed proximate the posterior end, would fall substantially on the sagittal plane while a central axis of the second receptacle 631, disposed proximate the anterior end, would extend away from the sagittal plane.

Figure 7:
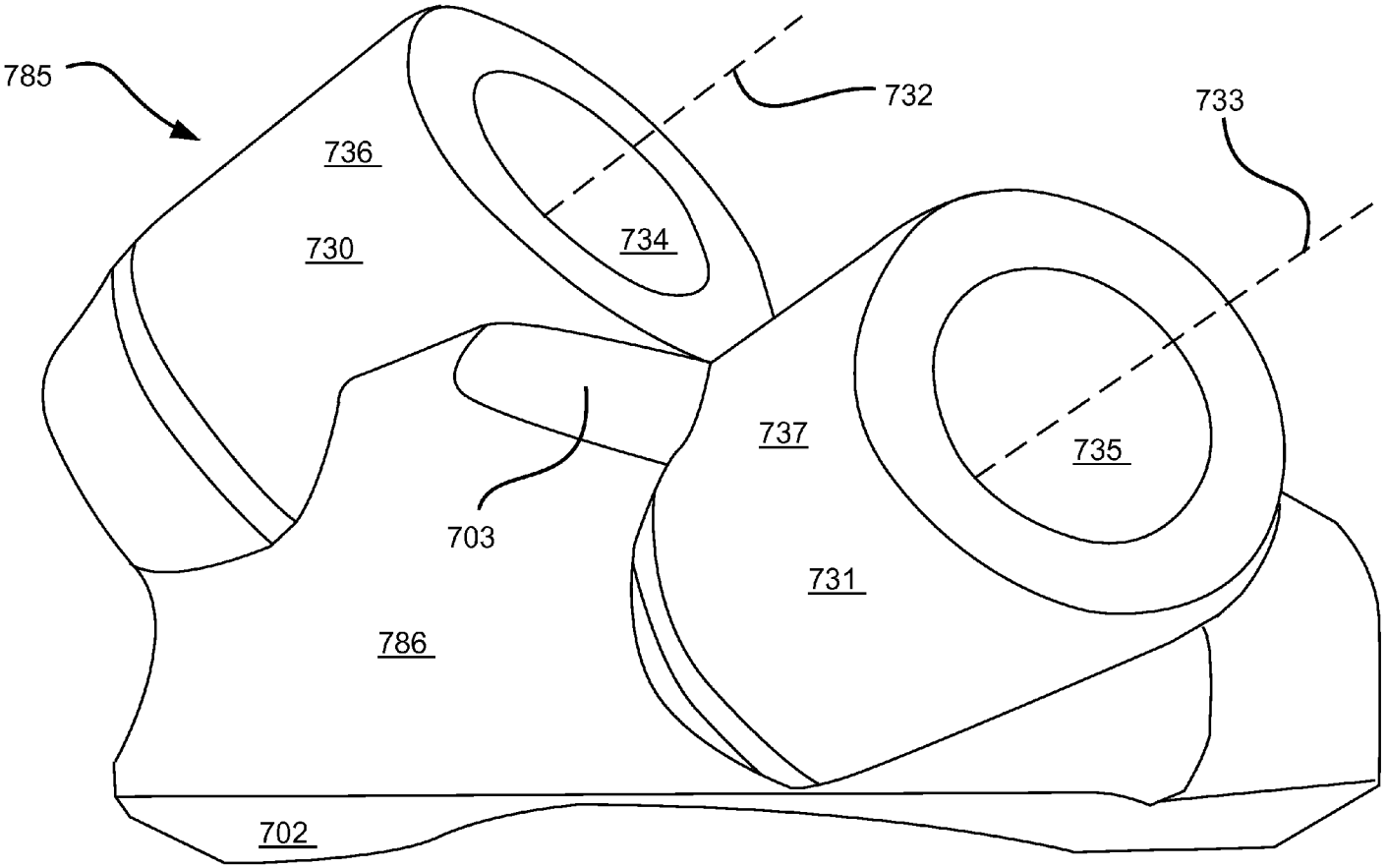
FIGS. 7 and 8 are orthogonal side views of embodiments of blocks comprising two and three receptacles respectively without any degradation picks.

FIG. 7 shows an embodiment of a high capacity block 785 comprising first and second receptacles 730, 731. As can be seen, the high capacity block 785 may be formed of a unitary mass. Furthermore, the first and second receptacles 730, 731 may be integrally formed of the unitary mass. For example, each of the first and second receptacles 730, 731 may comprise a bore hole 734, 735, respectively, extending into a unitary body 786 of the high capacity block 785. The first and second receptacles 730, 731 may also comprise supporting structures 736, 737, respectively, encompassing the bore holes 734, 735.

The first and second receptacles 730, 731 may be arranged such that a first central 732 axis of the first receptacle 730 may be nonparallel with a second central axis 733 of the second receptacle 731. Rather than aligning degradation picks along a single plane with each subsequent pick at a greater radial distance from a rotatable drum as described in the prior art, the configuration shown in the embodiment of FIG. 7 may allow for picks to be attached to a single block while minimizing the distance from any pick tip to the drum. By reducing the distance between the pick tips and the drum, the high capacity block may experience a lower stress when a force is applied to the tips, thus preventing failure of the high capacity block at its base surface.

Additionally, this configuration may allow picks to impact a formation at distinct points to more fully distribute forces among the plurality of picks. A cutting width of the drum may also be increased as a result.

Figure 8:
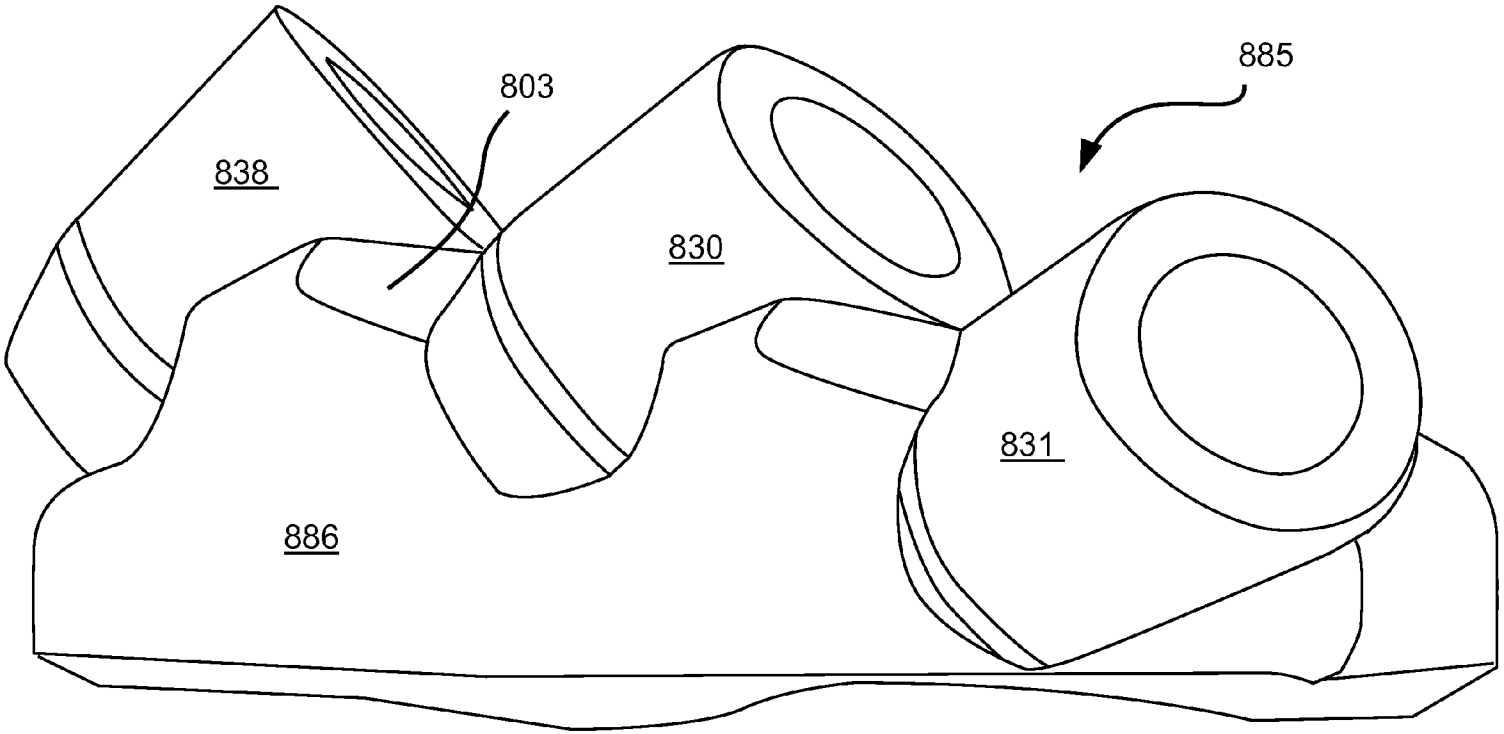

FIG. 8 shows an embodiment of a high capacity block 885 comprising a body 886 with first, second, and third receptacles 830, 831, 838, respectively, disposed thereon. In the embodiment shown, all three receptacles 830, 831, 838 have nonparallel central axes. Furthermore, if a sagittal plane were to pass through the body 886 from a posterior end to an anterior end thereof and separate the body 886 into two sides, a central axis of the second receptacle 831 would extend away from the sagittal plane on one side and a central axis of the third receptacle 838 would extend away from the sagittal plane an opposite side.

Whereas the present invention has been described in particular relation to the drawings attached hereto, it should be understood that other and further modifications apart from those shown or suggested herein, may be made within the scope and spirit of the present invention.

The invention claimed is:

1. A block for securing degradation picks to a movable support, comprising:

a body comprising a base surface rigidly attachable to a movable support and an external surface opposite the base surface, the body including a sagittal plane passing from a posterior end to an anterior end thereof, along a length of the body, and separating the body into two sides;

a first receptacle disposed on the external surface having a first central axis, the first axis extending substantially along the sagittal plane;

a first degradation pick removably disposed within the first receptacle, a distal tip of the first degradation pick being within a footprint of the base surface;

a second receptacle disposed on the external surface having a second central axis; and a second degradation pick removably disposed within the second receptacle, a distal tip of the second degradation pick extending beyond a footprint of the base surface;

wherein the first central axis and second central axis are nonparallel.

2. The block of claim 1, wherein the first receptacle is disposed proximate the posterior end and the second receptacle is disposed proximate the anterior end.

3. The block of claim 1, wherein the second central axis extends away from the sagittal plane.

4. The block of claim 1, further comprising at least one additional receptacle.

5. The block of claim 4, wherein all receptacles comprise nonparallel central axes.

6. The block of claim 4, wherein the second central axis and-a central axis of the at least one additional receptacle extend away from the sagittal plane on opposite sides of the sagittal plane.

7. The block of claim 1, wherein the body is rigidly attached to a movable support, a distal tip of either the first degradation pick or second degradation pick extends beyond an edge of the movable support and a distal tip of the other degradation pick lies within the edge.

8. The block of claim 1, wherein the first receptacle and second receptacle provide access to proximal ends of the first degradation pick and second degradation pick, respectively, such that they may be forced from the first receptacle and second receptacle.

9. The block of claim 8, wherein the base surface is shaped such that the proximal ends of the first and second degradation picks are accessible even when attached to a movable support.

10. The block of claim 1, wherein the body is formed of a unitary mass.

11. The block of claim 10, wherein the first receptacle and second receptacle are integrally formed of the unitary mass.

12. The block of claim 11, wherein the first receptacle and second receptacle each comprise a bore hole formed in the unitary mass.

13. The block of claim 12, wherein the first receptacle and second receptacle each comprise a supporting structure encompassing each bore hole.

14. The block of claim 9, wherein the first and second degradation picks extend fully through the first and second receptacles.

15. The block of claim 6, further comprising a third degradation pick removably disposed within the at least one additional receptacle.

16. The block of claim 6, wherein the second receptacle is disposed proximate the anterior end and the at least one additional receptacle is disposed proximate the posterior end.

* * * * *